United States Patent [19]

Reighart

[11] Patent Number: 5,027,947

[45] Date of Patent: Jul. 2, 1991

[54] RECLOSABLE SLEEVED BLISTER PACKAGE

[75] Inventor: Richard L. Reighart, Toledo, Ohio

[73] Assignee: Cooper Industries, Inc., Houston, Tex.

[21] Appl. No.: 574,984

[22] Filed: Aug. 29, 1990

[51] Int. Cl.[5] ..... B65D 75/36; B65D 85/20

[52] U.S. Cl. ..... 206/335; 53/397; 53/449; 53/471; 206/468; 206/806

[58] Field of Search ..... 53/397, 420, 449, 453, 53/467, 471; 206/44 R, 45.31, 45.34, 335, 443, 461, 462, 467, 468, 471, 806

[56] References Cited

U.S. PATENT DOCUMENTS

| | | | |
|---|---|---|---|
| 2,796,985 | 6/1957 | Gorton | 206/462 |
| 3,327,843 | 6/1967 | O'Meara et al. | 206/462 |
| 3,529,718 | 9/1970 | Zaremski | 206/469 |
| 4,180,165 | 12/1979 | Kuchenbecker | 206/45.34 |
| 4,239,104 | 12/1980 | Roccaforte et al. | 206/45.33 |
| 4,739,353 | 4/1988 | Heuer et al. | 206/45.31 |
| 4,842,141 | 6/1989 | Segal | 53/397 |
| 4,854,450 | 8/1989 | Fisher | 206/469 |
| 4,895,255 | 1/1990 | Fisher | 206/461 |

FOREIGN PATENT DOCUMENTS

| | | | |
|---|---|---|---|
| 2729808 | 1/1979 | Fed. Rep. of Germany | 206/466 |
| 1384547 | 2/1975 | United Kingdom | 206/468 |

*Primary Examiner*—Jimmy G. Foster

*Attorney, Agent, or Firm*—Eddie E. Scott; Alan R. Thiele; Nelson A. Blish

[57] ABSTRACT

A reclosable package includes a container to hold a commercial article. A portion of the back of the container is left open to form an area sufficient to remove the commercial article from the container. A sleeve, working in a sliding relationship with the container, is used to cover the removal area for shipment and display. The sleeve may be removed by the customer to reveal the removal area, allowing the customer to remove or return the commercial article without the need to damage the container. The same sleeve is reused to cover the removal area without damaging the package or the commercial article.

23 Claims, 5 Drawing Sheets

RECLOSABLE SLEEVED BLISTER PACKAGE

BACKGROUND OF THE INVENTION

The present invention relates to reclosable packages, more particularly, the present invention relates to reclosable packages for windshield wipers.

Prior art windshield wiper packages are typically constructed of a clear plastic blister comprising the front and sides, plus a cardboard backing. The entire package is sealed in order to protect the windshield wiper from damage during shipment or display.

It is the practice in the windshield wiper industry to allow customers to purchase windshield wipers on the condition that the device fits satisfactorly with the customer's vehicle. Often, a customer will purchase a wiper from a retail store. Upon returning to his vehicle, the customer breaks open the package and removes the windshield wiper therefrom. Occasionally, the customer discovers that the windshield wiper which he just purchased, does not fit his vehicle. In that case, the customer immediately returns the wiper and package to the retail store for a refund. Once opened, other customers are unwilling to buy that windshield wiper because of the damaged packaging.

There is therefore a need in the art for a reclosable package that may be opened to allow removal and return of the contents by a customer without damage to the package itself.

SUMMARY OF THE INVENTION

A reclosable package includes a hollow container to hold a commercial article. A portion of the back is left open in order to allow removal or replacement of the commercial article for trial fitting by the customer. A sleeve, working in a sliding relationship with the container, is used to cover the removal area of the container for shipment and display. By using the sliding feature of the sleeve, the customer may remove or return the commercial article without damaging the packaging.

A tab is attached to the top of the container. The tab contains an aperture used to hang the container on a display rack. The sleeve is constructed and arranged to expose the aperture in the tab when the sleeve covers the removal area of the container.

DESCRIPTION OF THE FIGURES

A better understanding of the reclosable package of the present invention may be obtained by reference to the drawings herein.

DESCRIPTION OF THE EMBODIMENTS

Figure 1:
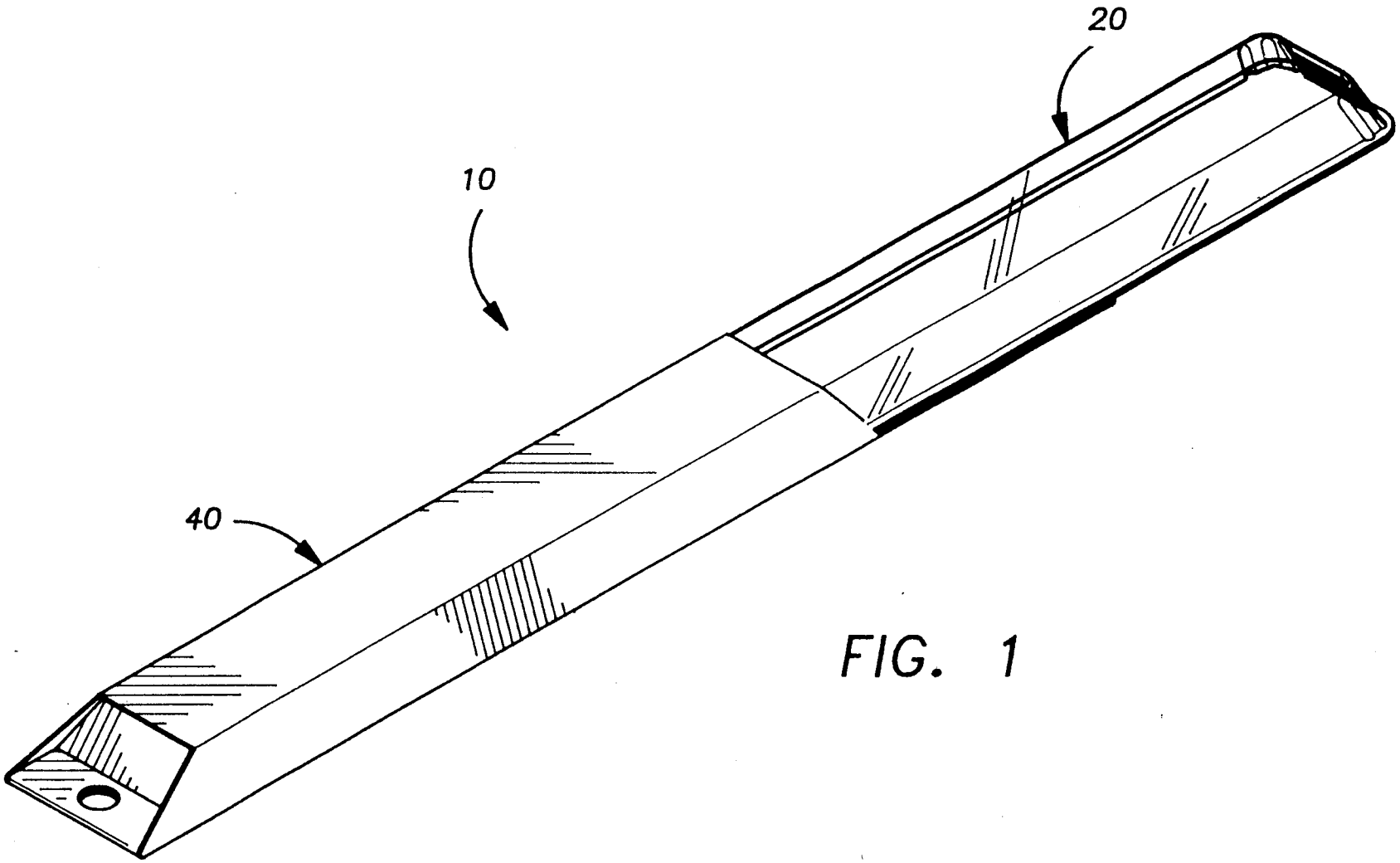
FIG. 1 is a front, top, side perspective view of the reclosable package of the present invention.

A reclosable package 10 of the present invention is shown in FIG 1. The sleeve assembly 40, working in a sliding relationship with the container assembly 20, may be repeatedly removed or replaced to respectively expose or cover the commercial article. When the sleeve assembly 40 is removed from the container assembly 20, a removal area 29 (FIG. 7) exposes the contents of the container to a customer, and allows removal or return of the contents without damage to the reclosable package 10.

Figure 2:
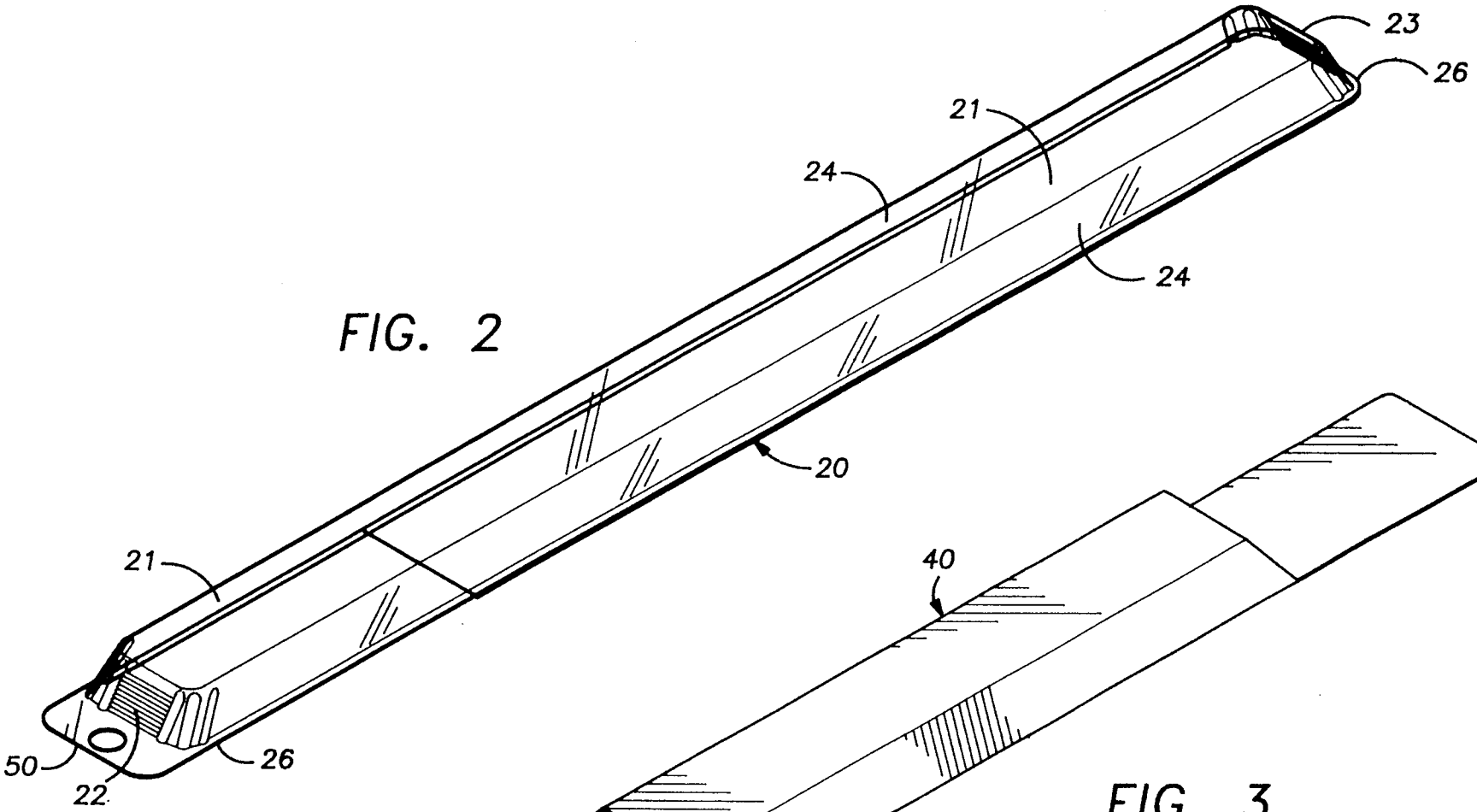
FIG. 2 is a front, top, side perspective view of the container of the present invention.
Figure 3:
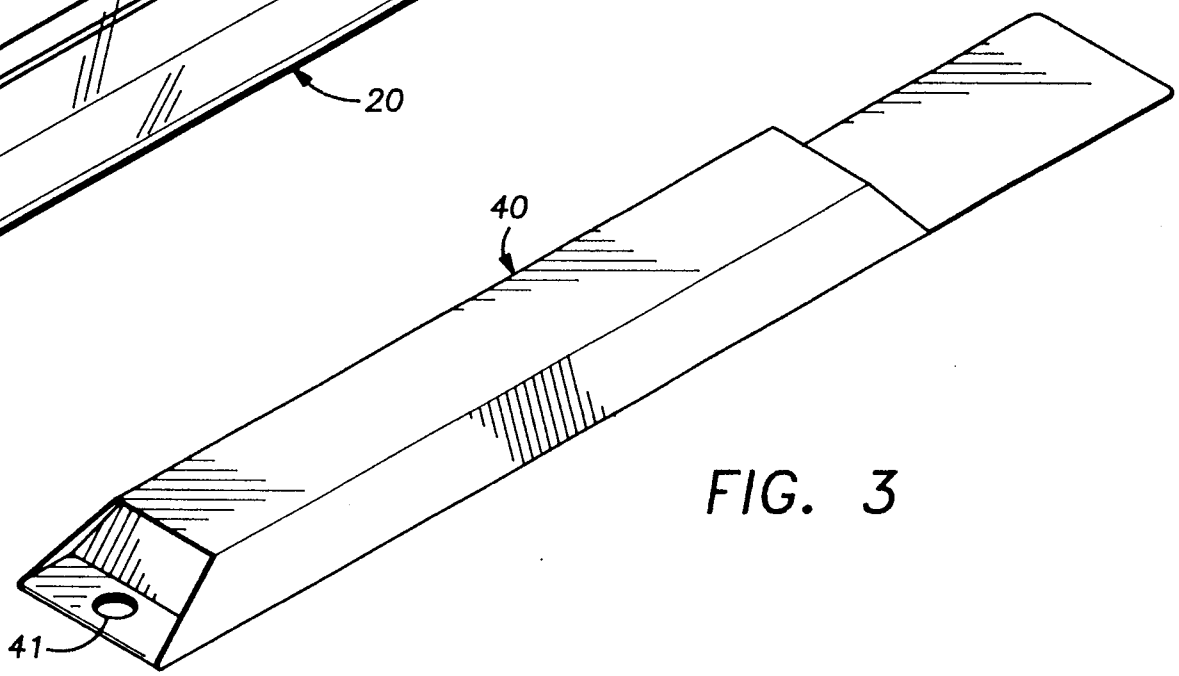
FIG. 3 is a front, top, side perspective view of the sleeve of the present invention.
Figure 4:
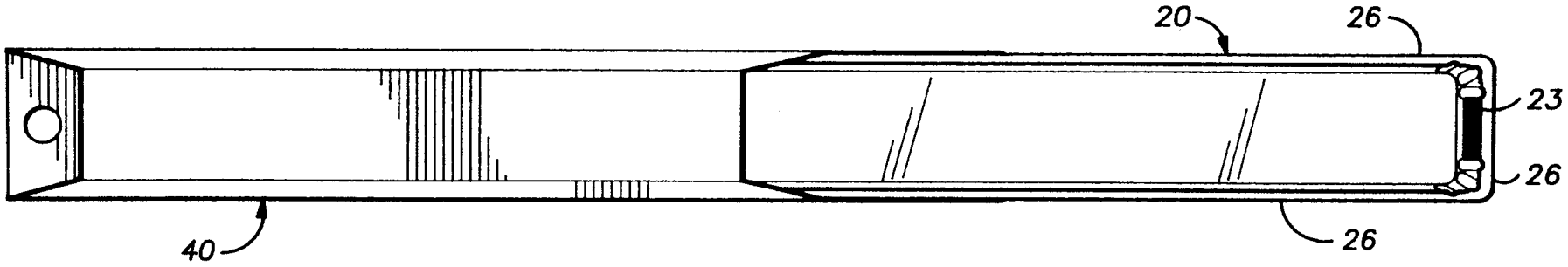
FIG. 4 is a front plan view of the reclosable package of the present invention.
Figure 5:
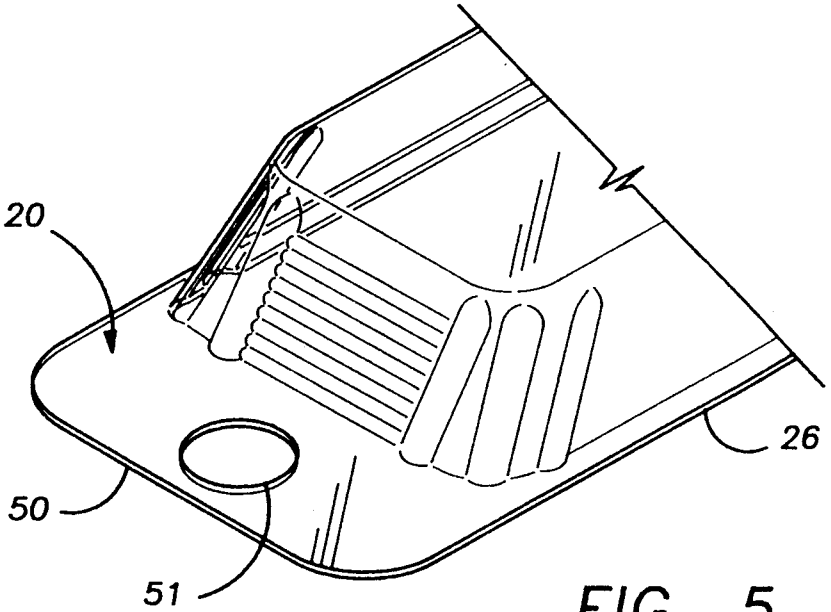
FIG. 5 is a front, top, side close-up perspective view of the container of the present invention.
Figure 7:
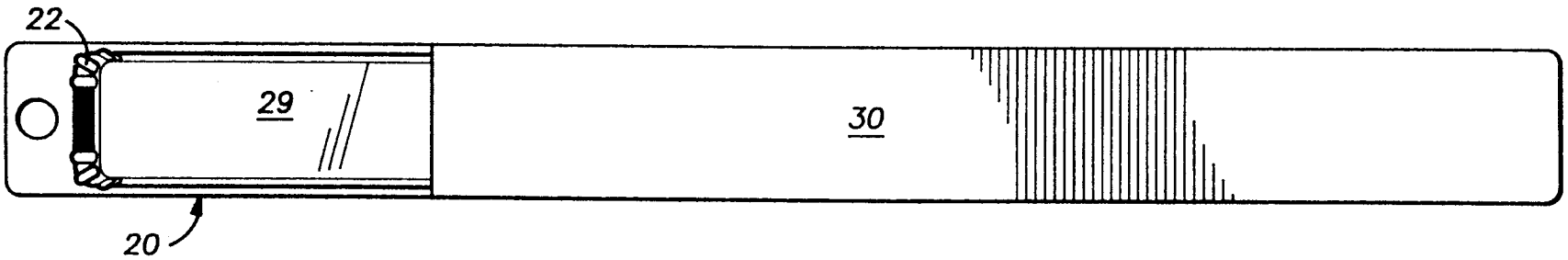
FIG. 7 is a back plan view of the container and the backing section of the present invention.
Figure 8:
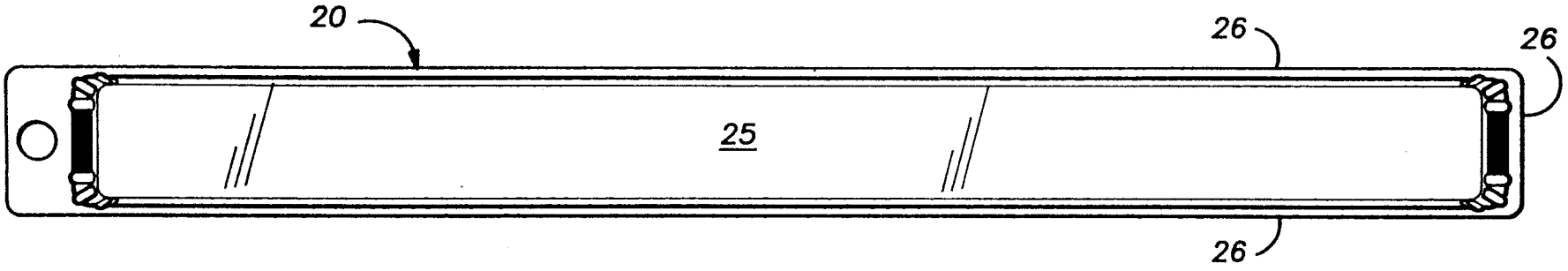
FIG. 8 is a back plan view of the container of the present invention.

The container assembly 20 may be constructed of any normal packaging material including, but not limited to: clear plastic, cardboard and non-clear plastic. The container assembly 20 as shown in FIG. 2 has a front 21, top 22, bottom 23, and two sides 24. The hollow volume 27 within the container assembly 20 is of sufficient size and shape to completely contain the desired commercial article. The back area 25 of the container assembly 20 is left open as shown in FIG. 8. A flange 26 is attached to the back edge of the sides 24 and bottom 23 as shown in FIG. 2, 5 and 8. A backing section 30 is attached to the flange 26 and covers the back area 25 from the bottom 23 to a point in the proximity of the top 22, leaving a removal area 29 as shown in FIG. 7.

The sleeve assembly 40 is constructed of common packaging material, including but not limited to: cardboard and plastic. The sleeve assembly 40, in order to work in a sliding relationship with container assembly 20 must necessarily be slightly larger than the width and depth of the container assembly 20. Clearances between the sleeve assembly 40 and the container assembly 20 should be such that the sleeve assembly 40 may be removed from the container assembly 20 without damage to either, yet allow sleeve assembly 40 to remain snug against container assembly 20 without the aid of additional fasteners.

Figure 6:
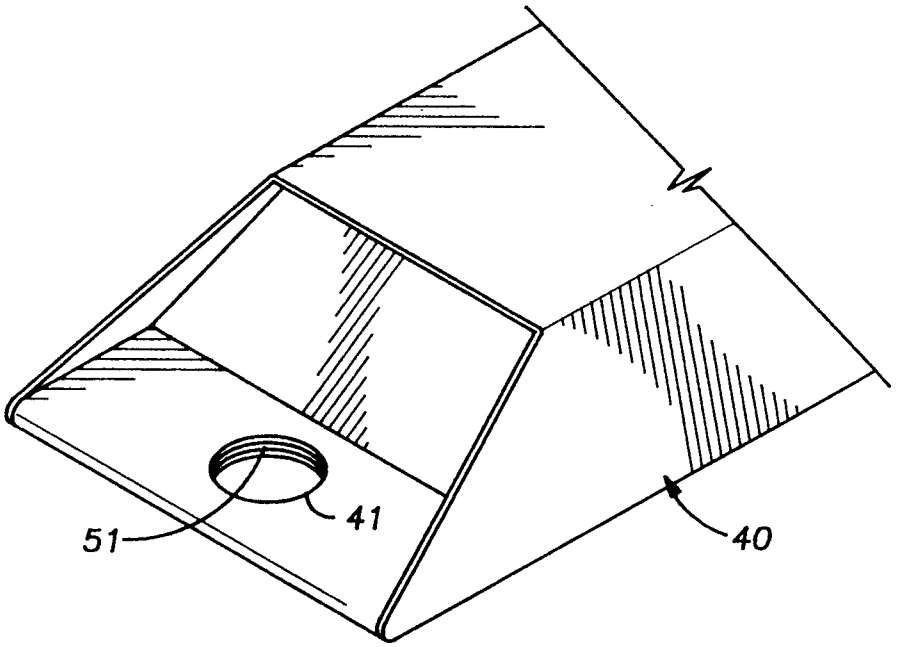
FIG. 6 is a front, top, side close-up perspective view of the sleeve of the present invention.
Figure 9:
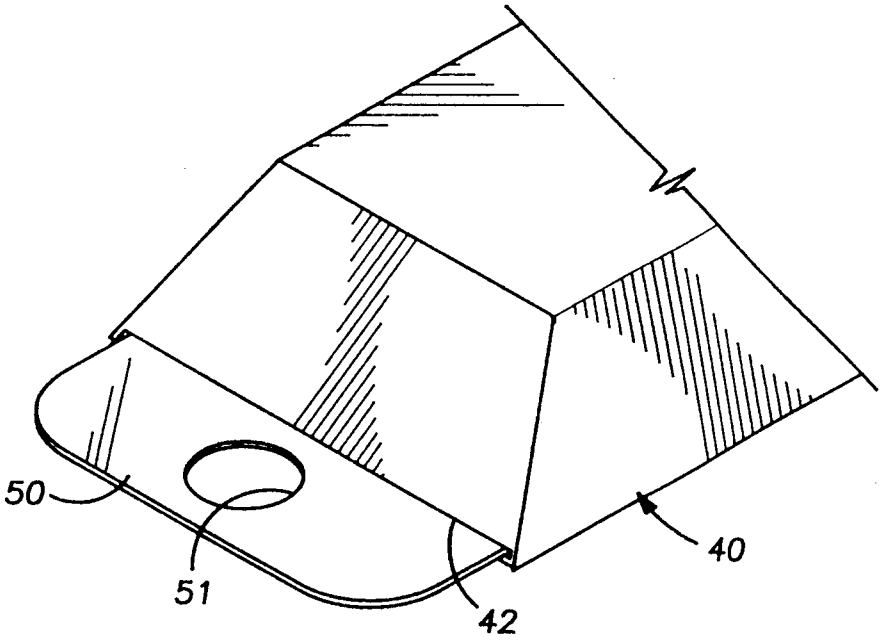
FIG. 9 is a front, top, side close-up perspective of an alternate embodiment of the present invention.

A tab 50 may be attached to the back edge of the top 21 as shown in FIG. 5. When a tab aperture hole 51 is placed within the tab 50, the container may be hung from a rack used to display the reclosable package 10. As the sleeve assembly 40 must slide over the top 21 and the tab 50, and because the tab aperture 51 must be exposed in order to be effective, the sleeve assembly 40 must be constructed to accommodate this need. In the preferred embodiment of the present invention, the sleeve assembly 40 encloses the tab 50 as shown in FIG. 6. Two sleeve apertures 41 are constructed and arranged to expose the tab aperture 51 when the sleeve assembly 40 covers the removal area 29 as shown in FIG. 1. An alternate method of solving this problem is to construct the sleeve assembly 40 with a slot 42 as shown in FIG. 9. When the sleeve assembly 40 is placed over the container assembly 20, the tab 50 passes through the slot 42, thereby exposing tab aperture 51.

According to the present invention, there is provided a reclosable package that allows a customer to inspect a commercial article without damaging the package. Still other embodiments of the reclosable package of the present invention will become apparent to those of ordinary skill in the art once having read the foregoing description and accompanying claims.

I claim:

1. A reclosable package, comprising:

a hollow container having a front, top, bottom, two sides, an open back, said hollow container constructed and arranged to contain a commercial article;

a backing section constructed and arranged to cover part of said open back of said hollow container leaving a removal area in the proximity of said top of said hollow container;

a sleeve, constructed and arranged to slide over said top of said hollow container, said sleeve covering said removal area in the proximity of said top of said hollow container in a slidable relationship;

whereby said commercial article may be removed from or returned to said hollow container without damaging said reclosable package.

2. A reclosable package as defined in claim 1 wherein a tab is attached to said top of said hollow container.

3. A reclosable package as defined in claim 2 wherein said tab has an aperture for hanging said hollow container.

4. A reclosable package as defined in claim 3 wherein said sleeve covers said tab, said sleeve having a plurality of apertures constructed and arranged to expose said aperture when said sleeve covers said removal area of said container.

5. A reclosable package as defined in claim 3 wherein said sleeve has a slot to allow said tab to pass through said sleeve when said sleeve covers said removal area of said container.

6. A reclosable package as defined in claim 1 wherein said hollow container is constructed from clear plastic.

7. A reclosable package as defined in claim 1 wherein said hollow container is constructed of cardboard.

8. A reclosable package as defined in claim 1 wherein said hollow container is constructed of plastic.

9. A reclosable package as defined in claim 1 wherein said backing section is constructed of plastic.

10. A reclosable package as defined in claim 1 wherein said backing section is constructed of cardboard.

11. A reclosable windshield wiper package comprising:

a windshield wiper;

a hollow container having a front, top, bottom, two sides, an open back, said hollow container constructed and arranged to contain said windshield wiper;

a backing section constructed and arranged to cover part of said open back of said hollow container leaving a removal area in the proximity of said top of said hollow container;

a sleeve, constructed and arranged to slide over said top of said hollow container, said sleeve covering said removal area in the proximity of said top of said hollow container in a slidable relationship;

whereby a portion of said windshield wiper may be removed from or returned to said hollow container without damaging said reclosable package.

12. A reclosable package as defined in claim 11 wherein a tab is attached to said top of said hollow container.

13. A reclosable package as defined in claim 12 wherein said tab has an aperture for hanging said hollow container.

14. A reclosable package as defined in claim 13 wherein said sleeve covers said tab, said sleeve having a plurality of apertures constructed and arranged to expose said aperture when said sleeve covers said removal area of said container.

15. A reclosable package as defined in claim 13 wherein said sleeve has a slot to allow said tab to pass through said sleeve when said sleeve covers said removal area of said container.

16. A reclosable package as defined in claim 11 wherein said hollow container is constructed from clear plastic.

17. A reclosable package as defined in claim 11 wherein said hollow container is constructed of cardboard.

18. A reclosable package as defined in claim 11 wherein said hollow container is constructed of plastic.

19. A reclosable package as defined in claim 11 wherein said backing section is constructed of plastic.

20. A reclosable package as defined in claim 11 wherein said backing section is constructed of cardboard.

21. A reclosable windshield wiper package comprising:

a windshield wiper;

a hollow container having a front, top, bottom, two sides, an open back, said hollow container constructed of clear plastic and arranged to contain said windshield wiper;

a tab attached to said top of said hollow container along the edge opposite of said front;

an aperture within said tab to allow said hollow container to be hung;

a backing section constructed of plastic and arranged to cover part of said open back of said hollow container leaving a removal area in the proximity of said top of said hollow container;

a sleeve, constructed of cardboard and arranged to slide over said top of said hollow container, said sleeve covering said removal area in the proximity of said top of said hollow container in a slidable relationship, said sleeve also covering said tab;

two apertures within said sleeve, said two apertures constructed and arranged to reveal said aperture within said tab when said sleeve covers said removal area in order to allow hanging said container when said sleeve covers said removal area;

whereby a portion of said windshield wiper may be removed from or returned to said hollow container without damaging said reclosable package.

22. A method for assembling a product with a reclosable package comprising the steps of:

placing a commercial article into a hollow container with an open back;

covering part of said open back with a backing section, leaving a portion of said open back uncovered;

sliding a sleeve over the uncovered portion of said open back of said hollow container.

23. A method for assembling a windshield wiper with a reclosable package comprising the steps of:

placing a windshield wiper into a hollow container with an open back;

covering part of said open back with a backing section, leaving a portion of said open back uncovered;

sliding a sleeve over the uncovered portion of said open back of said hollow container.

* * * * *